US009089032B2

(12) United States Patent
Bowers et al.

(10) Patent No.: US 9,089,032 B2
(45) Date of Patent: Jul. 21, 2015

(54) SYSTEM AND METHOD FOR COLOR TUNING LIGHT OUTPUT FROM AN LED-BASED LAMP

(71) Applicant: Lumenetix, Inc., Scotts Valley, CA (US)

(72) Inventors: David Bowers, San Jose, CA (US); Thomas Poliquin, Aptos, CA (US); Dustin Cochran, Boulder Creek, CA (US)

(73) Assignee: LUMENETIX, INC., Scotts Valley, CA (US)

( * ) Notice: Subject to any disclaimer, the term of this patent is extended or adjusted under 35 U.S.C. 154(b) by 301 days.

(21) Appl. No.: 13/766,695

(22) Filed: Feb. 13, 2013

(65) Prior Publication Data

US 2013/0234602 A1 Sep. 12, 2013

Related U.S. Application Data

(60) Provisional application No. 61/598,159, filed on Feb. 13, 2012.

(51) Int. Cl.
*H05B 33/08* (2006.01)

(52) U.S. Cl.
CPC ..... *H05B 33/0863* (2013.01); *H05B 33/086* (2013.01); *H05B 33/0869* (2013.01)

(58) Field of Classification Search
CPC ..... H05B 33/0857; H05B 33/086; H05B 37/0218; H05B 39/042; H05B 39/02; H05B 41/38; H05B 41/386; H05B 41/388; H05B 41/392; H05B 41/33921; H05B 41/3922
USPC ..... 315/151–153, 158, 307–308, 324–325
See application file for complete search history.

(56) References Cited

U.S. PATENT DOCUMENTS

| | | | |
|---|---|---|---|
| 5,099,348 | A | 3/1992 | Huddleston et al. |
| 5,457,478 | A | 10/1995 | Frank |
| 6,128,117 | A | 10/2000 | Kim |

(Continued)

FOREIGN PATENT DOCUMENTS

| | | | |
|---|---|---|---|
| JP | 2005-011628 | A | 1/2005 |
| JP | 2006-059605 | A | 3/2006 |

(Continued)

OTHER PUBLICATIONS

Co-Pending U.S. Appl. No. 12/396,399 of Weaver, M.D., filed Mar. 2, 2009.

(Continued)

*Primary Examiner* — An Luu
(74) *Attorney, Agent, or Firm* — Perkins Coie LLP

(57) ABSTRACT

Systems and methods for using an LED-based lamp for reproducing a target light are disclosed. A color-space searching technique is introduced here that enables the LED-based lamp to be tuned to generate light at a specific CCT by adjusting the amount of light contributed by each of the LED strings in the lamp. The target light is decomposed into different wavelength bands, and light generated by the LED-based lamp is also decomposed into the same wavelength bands and compared. The color-searching techniques allow the LED-based lamp to closely emulate a black body radiator given the limitations of the physical specification of color string in the LED strings.

30 Claims, 8 Drawing Sheets

(56) References Cited

U.S. PATENT DOCUMENTS

| | | | | |
|---|---|---|---|---|
| 6,411,046 | B1 | 6/2002 | Muthu | |
| 7,423,387 | B2 | 9/2008 | Robinson | |
| 8,928,249 | B2 * | 1/2015 | Raj et al. | 315/291 |
| 2002/0097000 | A1 | 7/2002 | Muthu et al. | |
| 2002/0114155 | A1 | 8/2002 | Katogi et al. | |
| 2004/0008992 | A1 | 1/2004 | Nishimura | |
| 2004/0105264 | A1 | 6/2004 | Spero | |
| 2005/0030744 | A1 | 2/2005 | Ducharme et al. | |
| 2005/0047134 | A1 | 3/2005 | Mueller et al. | |
| 2005/0128751 | A1 | 6/2005 | Roberge et al. | |
| 2007/0183163 | A1 | 8/2007 | Daniel | |
| 2007/0248047 | A1 | 10/2007 | Shorty et al. | |
| 2008/0191631 | A1 | 8/2008 | Archenbold et al. | |
| 2009/0040750 | A1 | 2/2009 | Myer | |
| 2009/0184648 | A1 | 7/2009 | Colak et al. | |
| 2009/0218951 | A1 | 9/2009 | Weaver | |
| 2009/0267524 | A1 | 10/2009 | Draaijer et al. | |
| 2010/0110672 | A1 | 5/2010 | Durand et al. | |
| 2010/0188004 | A1 | 7/2010 | Baggen et al. | |
| 2010/0231363 | A1 | 9/2010 | Knibbe | |
| 2010/0244746 | A1 | 9/2010 | Van De Sluis et al. | |
| 2010/0301776 | A1 | 12/2010 | Feri et al. | |
| 2011/0044701 | A1 | 2/2011 | Schenk et al. | |

FOREIGN PATENT DOCUMENTS

| | | | |
|---|---|---|---|
| WO | WO-02/47436 | A2 | 2/2002 |
| WO | WO-02/47438 | A2 | 6/2002 |
| WO | WO-02/082283 | A2 | 10/2002 |
| WO | WO-02/082863 | A1 | 10/2002 |
| WO | WO-03/055273 | A2 | 7/2003 |
| WO | WO-2004/057927 | A1 | 7/2004 |
| WO | WO-2006/111934 | A1 | 10/2006 |
| WO | WO-2007/125477 | A2 | 11/2007 |

OTHER PUBLICATIONS

Co-Pending U.S. Appl. No. 12/782,038 of Weaver, M. et al., filed May 18, 2010.
Co-Pending U.S. Appl. No. 13/367,187 of Weaver, M.D., filed Feb. 6, 2012.
Co-Pending U.S. Appl. No. 13/627,926 of Weaver, M.D., filed Sep. 26, 2012.
Co-Pending U.S. Appl. No. 13/655,679 of Weaver, M.D., filed Oct. 19, 2012.
Co-Pending U.S. Appl. No. 13/655,738 of Weaver, M,D., filed Oct. 19, 2012.
Co-Pending U.S. Appl. No. 13/766,707 of Bowers, D., filed Feb. 13, 2013.
Co-Pending U.S. Appl. No. 13/766,745 of Bowers, D. et al., filed Feb. 13, 2012.
Co-Pending U.S. Appl. No. 13/770,595 of Weaver, M.D., filed Feb. 19, 2013.
Co-Pending U.S. Appl. No. 13/848,628 of Weaver, M.D., filed Mar. 21, 2013.
Non-Final Office Action Mailed Sep. 23, 2011 in Co-Pending U.S. Appl. No. 12/396,399 of Weaver, M.D., filed Mar. 2, 2009.
Final Officfe Action Mailed Dec. 5, 2012 in Co-Pending U.S. Appl. No. 12/396,399 of Weaver, M.D., filed Mar. 2, 2009.
Non-Final Office Action Mailed Jan. 4, 2013 in Co-Pending U.S. Patent Application No. 12/396,399 of Weaver, M.D., filed Mar. 2, 2009.
Notice of Allowance Mailed Mar. 20, 2013 in Co-Pending U.S. Appl. No. 12/396,399 of Weaver, M.D., filed Mar. 2, 2009.
Restriction Requirement mailed Mar. 25, 2013 for Co-Pending U.S. Appl. No. 12/782,038 of Weaver, M., filed May 18, 2010.
Non-Final Office Action Mailed Dec. 4, 2012 in Co-Pending U.S. Appl. No. 13/627,926 Weaver, M.D., filed Sep. 26, 2012.
Non-Final Office Action Mailed Feb. 28, 2013 in Co-Pending U.S. Appl. No. 13/655,738 Weaver, M.D., filed Oct. 19, 2010.
International Search Report mailed Dec. 28, 2010, for International Patent Application No. PCT/2010/035295 filed May 18, 2010, pp. 1-8.
Written Opinion mailed Dec. 28, 2010, for International Patent Application Number PCT/2010/035295 filed May 18, 2010, pp. 1-5.
Non-Final Office Action mailed Dec. 5, 2013, for Co-Pending U.S. Appl. No. 12/782,038 by Weaver, M., filed May 18, 2010.
Notice of Allowance mailed May 13, 2014, for Co-Pending U.S. Appl. No. 12/782,038 by Weaver, M., filed May 18, 2010.
Non-Final Office Action mailed May 12, 2015, for U.S. Appl. No. 14/447,448 by Weaver, M. et al., filed Jul. 30, 2014.

* cited by examiner

| | measurement A | measurement B | measurement C | measurement D | measurement E |
|---|---|---|---|---|---|
| string 1 | on | off | on | off | off |
| string 2 | on | off | off | on | off |
| string 3 | on | off | off | off | on |

| | measurement F | measurement G | measurement H |
|---|---|---|---|
| string 1 | on | on | off |
| string 2 | on | off | on |
| string 3 | off | on | on |

*FIG. 5*

SYSTEM AND METHOD FOR COLOR TUNING LIGHT OUTPUT FROM AN LED-BASED LAMP

CROSS-REFERENCES TO RELATED APPLICATIONS

This application claims the benefit of U.S. Provisional Patent Application Ser. No. 61/598,159 filed Feb. 13, 2012. This application is related to U.S. patent application Ser. No. 12/782,038, entitled, "LAMP COLOR MATCHING AND CONTROL SYSTEMS AND METHODS", filed May 18, 2010. These applications are incorporated herein in their entirety.

BACKGROUND

Conventional systems for controlling lighting in homes and other buildings suffer from many drawbacks. One such drawback is that these systems rely on conventional lighting technologies, such as incandescent bulbs and fluorescent bulbs. Such light sources are limited in many respects. For example, such light sources typically do not offer long life or high energy efficiency. Further, such light sources offer only a limited selection of colors, and the color or light output of such light sources typically changes or degrades over time as the bulb ages. In systems that do not rely on conventional lighting technologies, such as systems that rely on light emitting diodes ("LEDs"), long system lives are possible and high energy efficiency can be achieved. However, in such systems issues with color quality can still exist.

A light source can be characterized by its color temperature and by its color rendering index ("CRI"). The color temperature of a light source is the temperature at which the color of light emitted from a heated black-body radiator is matched by the color of the light source. For a light source which does not substantially emulate a black body radiator, such as a fluorescent bulb or an LED, the correlated color temperature ("CCT") of the light source is the temperature at which the color of light emitted from a heated black-body radiator is approximated by the color of the light source. The CRI of a light source is a measure of the ability of a light source to reproduce the colors of various objects faithfully in comparison with an ideal or natural light source. The CCT and CRI of LED light sources is typically difficult to tune and adjust. Further difficulty arises when trying to maintain an acceptable CRI while varying the CCT of an LED light source.

SUMMARY

Systems and methods for using an LED-based lamp for reproducing a target light are disclosed. A color-space searching technique is introduced here that enables the LED-based lamp to be tuned to generate light at a specific CCT by adjusting the amount of light contributed by each of the LED strings in the lamp. The target light is decomposed into different wavelength bands, and light generated by the LED-based lamp is also decomposed into the same wavelength bands and compared. The color-searching techniques allow the LED-based lamp to closely emulate a black body radiator given the limitations of the physical specification of color string in the LED strings.

A color model for the LED-based lamp further provides information on how hard to drive each LED string in the lamp to generate light over a range of CCTs, and the color model is used to search for the appropriate operating point of the lamp to reproduce the target light.

BRIEF DESCRIPTION OF THE DRAWINGS

Examples of a remotely controllable LED-based lighting system are illustrated in the figures. The examples and figures are illustrative rather than limiting.

FIG. 5 shows a table of various types of measurement taken during the calibration process for a three-string LED lamp.

DETAILED DESCRIPTION

An LED-based lamp is used to substantially reproduce a target light. The correlated color temperature (CCT) of light generated by the lamp is tunable by adjusting the amount of light contributed by each of the LED strings in the lamp. The target light is decomposed into different wavelength bands by using a multi-element sensor that has different wavelength passband filters. Light generated by the LED-based lamp is also decomposed into the same wavelength bands using the same multi-element sensor and compared. A color model for the lamp provides information on how hard to drive each LED string in the lamp to generate light over a range of CCTs, and the color model is used to search for the appropriate operating point of the lamp to reproduce the target light. Further, the LED-based lamp can calibrate the output of its LED strings to ensure that the CCT of the light produced by the lamp is accurate over the life of the lamp. A controller allows a user to remotely command the lamp to reproduce the target light or calibrate the lamp output.

In one embodiment, the color model is developed by an expert system. Different custom color models can be developed for a lamp, and the color models are then stored at the lamp.

In one embodiment, a user interface for the controller can be provided on a smart phone. The smart phone then communicates with an external unit either through wired or wireless communication, and the external unit subsequently communicates with the LED-based lamp to be controlled.

Various aspects and examples of the invention will now be described. The following description provides specific details for a thorough understanding and enabling description of these examples. One skilled in the art will understand, however, that the invention may be practiced without many of these details. Additionally, some well-known structures or functions may not be shown or described in detail, so as to avoid unnecessarily obscuring the relevant description.

The terminology used in the description presented below is intended to be interpreted in its broadest reasonable manner, even though it is being used in conjunction with a detailed description of certain specific examples of the technology. Certain terms may even be emphasized below; however, any terminology intended to be interpreted in any restricted manner will be overtly and specifically defined as such in this Detailed Description section.

The Lighting System

Figure 1:
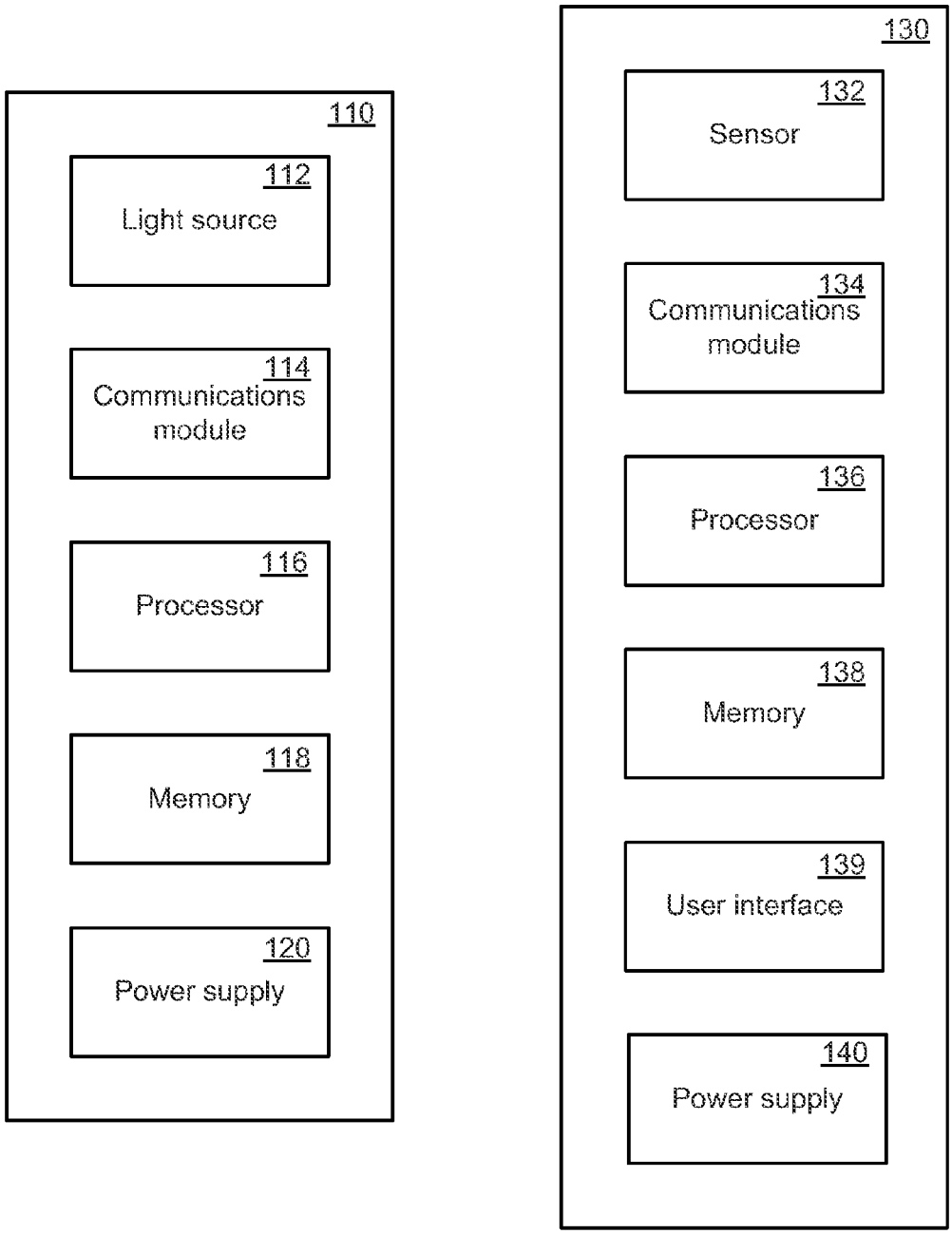
FIG. 1 shows a block diagram illustrating an example of an LED-based lamp or lighting node and a controller for the LED-based lamp or lighting node.
Figure 2A:
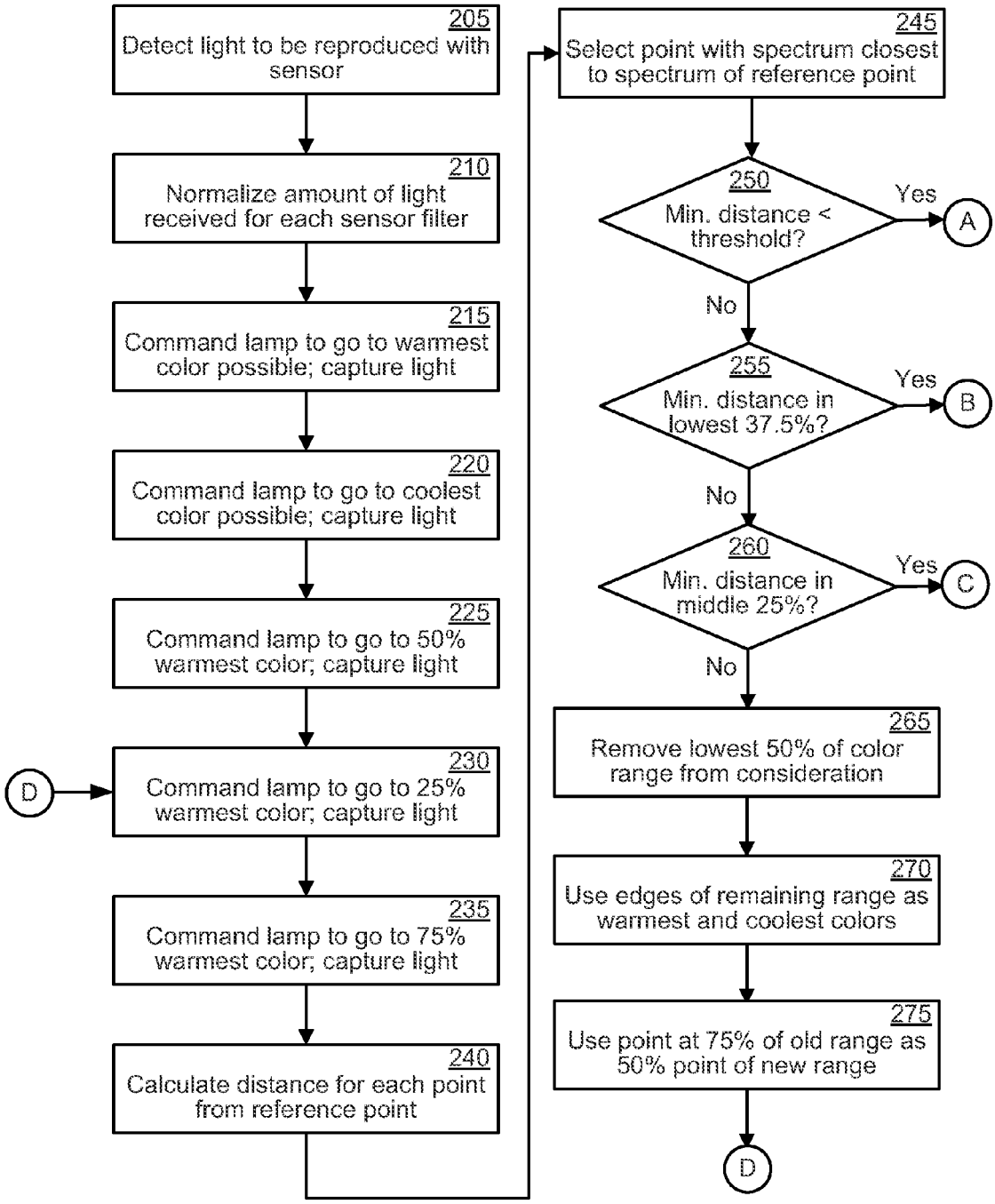
FIGS. 2A-2D is a flow diagram illustrating an example process of taking a sample of an existing light and reproducing the light with an LED-based lamp.
Figure 2B:
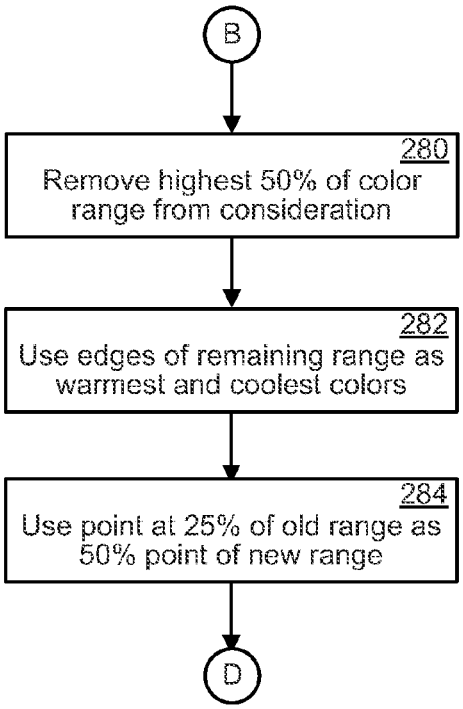
Figure 2C:
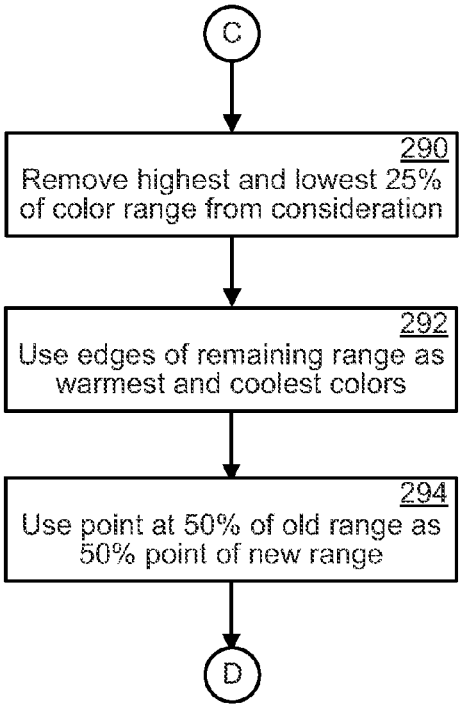
Figure 2D:
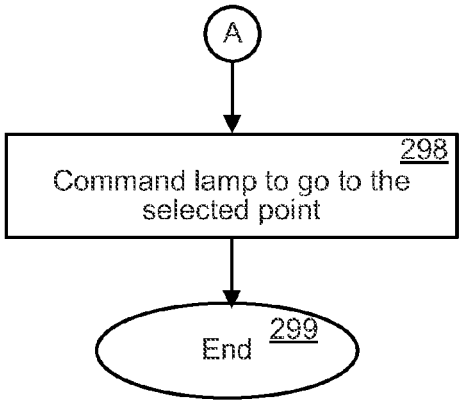

FIG. 1 shows a block diagram illustrating an example of an LED-based lamp or lighting node 110 and a controller 130 for the LED-based lamp or lighting node 110.

The LED-based lamp or lighting node 110 can include, for example, light source 112, communications module 114, processor 116, memory 118, and/or power supply 120. The controller 130 can include, for example, sensor 132, communications module 134, processor 136, memory 138, user interface 139, and/or power supply 140. Additional or fewer components can be included in the LED-based lamp 110 and the controller 130.

One embodiment of the LED-based lamp 110 includes light source 112. The light source 112 includes one or more LED strings, and each LED string can include one or more LEDs. In one embodiment, the LEDs in each LED string are configured to emit light having the same or substantially the same color. For example, the LEDs in each string can have the same peak wavelength within a given tolerance. In another embodiment, one or more of the LED strings can include LEDs with different colors that emit at different peak wavelengths or have different emission spectra. In some embodiments, the light source 112 can include sources of light that are not LEDs.

One embodiment of LED-based lamp 110 includes communications module 114. The LED-based lamp 110 communicates with the controller 130 through the communications module 114. In one embodiment, the communications module 114 communicates using radio frequency (RF) devices, for example, an analog or digital radio, a packet-based radio, an 802.11-based radio, a Bluetooth radio, or a wireless mesh network radio.

Because RF communications are not limited to line of sight, any LED-based lamp 110 that senses an RF command from the controller 130 will respond. Thurs, RF communications are useful for broadcasting commands to multiple LED-based lamps 110. However, if the controller needs to get a response from a particular lamp, each LED-based lamp 110 that communicates with the controller 130 should have a unique identification number or address so that the controller 130 can identify the particular LED-based lamp 110 that a command is intended for. The details regarding identifying individual lighting nodes can be found in U.S. patent application Ser. No. 12/782,038, entitled, "LAMP COLOR MATCHING AND CONTROL SYSTEMS AND METHODS" and is incorporated by reference.

Alternatively or additionally, the LED-based lamp 110 can communicate with the controller 130 using optical frequencies, such as with an IR transmitter and IR sensor or with a transmitter and receiver operates at any optical frequency. In one embodiment, the light source 112 can be used as the transmitter. A command sent using optical frequencies to a LED-based lamp 110 can come from anywhere in the room, so the optical receiver used by the LED-based lamp 110 should have a large receiving angle.

One embodiment of the LED-based lamp 110 includes processor 116. The processor 116 processes commands received from the controller 130 through the communications module 114 and responds to the controller's commands. For example, if the controller 130 commands the LED-based lamp 110 to calibrate the LED strings in the light source 112, the processor 116 runs the calibration routine as described in detail below. In one embodiment, the processor 116 responds to the controller's commands using a command protocol described below.

One embodiment of the LED-based lamp 110 includes memory 118. The memory stores a color model for the LED strings that are in the light source 112, where the color model includes information about the current level each LED string in the light source should be driven at to generate a particular CCT light output from the LED-based lamp 110. The memory 118 can also store filter values determined during a calibration process. In one embodiment, the memory 118 is non-volatile memory.

The light source 112 is powered by a power supply 120. In one embodiment, the power supply 120 is a battery. In some embodiments, the power supply 120 is coupled to an external power supply. The current delivered by the power supply to the LED strings in the light source 112 can be individually controlled by the processor 116 to provide the appropriate amounts of light at particular wavelengths to produce light having a particular CCT.

The controller 130 is used by a user to control the color and/or intensity of the light emitted by the LED-based lamp 110. One embodiment of the controller 130 includes sensor 132. The sensor 132 senses optical frequency wavelengths and converts the intensity of the light to a proportional electrical signal. The sensor can be implemented using, for example, one or more photodiodes, one or more photodetectors, a charge-coupled device (CCD) camera, or any other type of optical sensor.

One embodiment of the controller 130 includes communications module 134. The communications module 134 should be matched to communicate with the communications module 114 of the LED-based lamp 110. Thus, if the communications module 114 of the lamp 110 is configured to receive and/or transmit RF signals, the communications module 134 of the controller 130 should likewise be configured to transmit and/or receive RF signals. Similarly, if the communications module 114 of the lamp 110 is configured to receive and/or transmit optical signals, the communications module 134 of the controller 130 should likewise be configured to transmit and/or receive optical signals.

One embodiment of the controller 130 includes the processor 136. The processor 136 processes user commands received through the user interface 139 to control the LED-based lamp 110. The processor 136 also transmits to and receives communications from the LED-based lamp 110 for carrying out the user commands.

One embodiment of the controller 130 includes memory 138. The memory 138 may include but is not limited to, RAM, ROM, and any combination of volatile and non-volatile memory.

The controller 130 includes user interface 139. In one embodiment, the user interface 139 can be configured to be hardware-based. For example, the controller 130 can include buttons, sliders, switches, knobs, and any other hardware for directing the controller 130 to perform certain functions. Alternatively or additionally, the user interface 139 can be configured to be software-based. For example, the user interface hardware described above can be implemented using a software interface, and the controller can provide a graphical user interface for the user to interact with the controller 130.

The controller 130 is powered by a power supply 140. In one embodiment, the power supply 120 is a battery. In some embodiments, the power supply 120 is coupled to an external power supply.

Command Protocol

The controller 130 and the LED-based lamp 110 communicate using a closed loop command protocol. When the controller 130 sends a command, it expects a response from the LED-based lamp 110 to confirm that the command has been received. If the controller 130 does not receive a response, then the controller 130 will re-transmit the same command again. To ensure that the controller 130 receives a response to the appropriate corresponding command, each message that is sent between the controller 130 and the LED-based lamp 110 includes a message identification number.

The message identification number is part of a handshake protocol that ensures that each command generates one and only one action. For example, if the controller commands the lamp to increase intensity of an LED string by 5% and includes a message identification number, upon receiving the command, the lamp increases the intensity and sends a response to the controller acknowledging the command with the same message identification number. If the controller does not receive the response, the controller resends the command with the same message identification number. Upon receiving the command a second time, the lamp will not increase the intensity again but will send a second response to the controller acknowledging the command along with the message identification number. The message identification number is incremented each time a new command is sent.

Color Model

The LED strings in the LED-based lamp 110 are characterized to develop a color model that is used by the LED-based lamp 110 to generate light having a certain CCT. The color model is stored in memory at the lamp. In one embodiment, the color model is in the format of an array that includes information on how much luminous flux each LED string should generate in order to produce a total light output having a specific CCT. For example, if the user desires to go to a CCT of 3500° K, and the LED-based lamp 110 includes four color LED strings, white, red, blue, and amber, the array can be configured to provide information as to the percentage of possible output power each of the four LED strings should be driven at to generate light having a range of CCT values.

The array includes entries for the current levels for driving each LED string for CCT values that are along or near the Planckian locus. The Planckian locus is a line or region in a chromaticity diagram away from which a CCT measurement ceases to be meaningful. Limiting the CCT values that the LED-based lamp 110 generates to along or near the Planckian locus avoids driving the LED strings of the LED-based lamp 110 in combinations that do not provide effective lighting solutions.

The array can include any number of CCT value entries, for example, 256. If the LED-based lamp 110 receives a command from the controller 130 to generate, for example, the warmest color that the lamp can produce, the LED-based lamp 110 will look up the color model array in memory and find the amount of current needed to drive each of its LED strings corresponding to the lowest CCT in its color model. For an array having 256 entries from 1 to 256, the warmest color would correspond to entry 1. Likewise, if the command is to generate the coolest color that the lamp can produce, the LED-based lamp 110 will look up in the color model the amount of current needed to drive the LED strings corresponding to the highest CCT. For an array having 256 entries from 1 to 256, the coolest color would correspond to entry 256. If the command specifies a percentage point within the operating range of the lamp, for example 50%, the LED-based lamp 110 will find 50% of its maximum range of values in the array (256) and go to the current values for the LED strings corresponding to point 128 within the array.

The color model that is developed for the LED-based lamp 110 is particular to the LEDs used in the particular LED-based lamp 110 and based upon experimental data rather than a theoretical model that uses information provided by manufacturer data sheets. For example, a batch of binned LEDs received from a manufacturer is supposed to have LEDs that emit at the same or nearly the same peak wavelengths.

A color model can be developed experimentally for an LED-based lamp 110 by using a spectrum analyzer to measure the change in the spectrum of the combined output of the LED strings in the lamp. While the manufacturer of LEDs may provide a data sheet for each bin of LEDs, the LEDs in a bin can still vary in their peak wavelength and in the produced light intensity (lumens per watt of input power or lumens per driving current). If even a single LED has a peak wavelength or intensity variation, the resulting lamp CCT can be effected, thus the other LED strings require adjustment to compensate for the variation of that LED. The LEDs are tested to confirm their spectral peaks and to determine how hard to drive a string of the LEDs to get a range of output power levels.

Ultimately, multiple different color LED strings are used together in a lamp to generate light with a tunable CCT. The CCT is tuned by appropriately varying the output power level of each of the LED strings. Also, there are many different interactions among the LED strings that should be accounted for when developing a color model. Some interactions may have a larger effect than other interactions, and the interactions are dependent upon the desired CCT. For example, if the desired CCT is in the lower range, variation in the red LED string will have a large effect.

In one embodiment, one or more custom color models can be developed and stored in the lamp. For example, if a customer wants to optimize the color model for intensity of the light where the quality of the generated light is not as important as the intensity, a custom color model can be developed for the lamp that just produces light in a desired color range but provides a high light intensity. Or if a customer wants a really high quality of light where the color is important, but the total intensity is not, a different color model can be developed. Different models can be developed by changing the amount of light generated by each of the different color LED strings in the lamp. These models can also be developed by the expert system.

Essentially, the color model is made up of an array of multiplicative factors that quantify how hard each LED string should be driven to achieve a certain CCT for the lamp output. Once a color model for the LED strings in a lamp has been developed, it is stored in a memory in that lamp. The color model can be adjusted or updated remotely by the controller. Additionally, new custom color models can be developed and uploaded to the lamp at any point in the life of the lamp.

'Copying and Pasting' an Existing Light

FIGS. 2A-2D is a flow diagram illustrating an example process of taking a sample of an existing light and reproducing the light with an LED-based lamp.

At block 205, when the user aims the sensor on the controller toward the light to be reproduced, the sensor detects the light and generates an electrical signal that is proportional to the intensity of the detected light. In one embodiment, multiple samples of the light are taken and averaged together to obtain a CCT reference point. The CCT reference point will be compared to the CCT of light emitted by the LED-based lamp in this process until the lamp reproduces the CCT of the reference point to within an acceptable tolerance.

Because the light generated by the LED-based lamp 110 is restricted to CCT values along the Planckian locus, reproducing the spectrum of the reference point is essential a one-dimensional search for a CCT value along the Planckian locus that matches the CCT of the reference light to be reproduced.

One or more sensors can be used to capture the light to be reproduced. The analysis and reproduction of the spectrum of the reference point are enabled when the one or more sensors can provide information corresponding to light intensity values in more than one band of wavelengths. Information relating to a band of wavelengths can be obtained by using a bandpass filter over different portions of the sensor, provided that each portion of the sensor receives a substantially similar amount of light. In one embodiment, a Taos 3414CS RGB color sensor is used. The Taos sensor has an 8×2 array of filtered photodiodes. Four of the photodiodes have red bandpass filters, four have green bandpass filters, four have blue bandpass filters, and four use no bandpass filter, i.e. a clear filter. The Taos sensor provides an average value for the light intensity received at four the photodiodes within each of the four groups of filtered (or unfiltered) photodiodes. For example, the light received by the red filtered photodiodes provides a value R, the light received by the green photodiodes provides a value G, the light received by the blue filtered photodiodes provides a value B, and the light received by the unfiltered photodiodes provides a value U.

The unfiltered value U includes light that has been measured and included in the other filtered values R, G, and B. The unfiltered value U can be adjusted to de-emphasize the light represented by the filtered values R, G, and B by subtracting a portion of their contribution from U. In one embodiment, the adjusted value U' is taken to be U−(R+G+B)/3.

At block 210, the processor in the controller normalizes the received values for each filtered (or unfiltered) photodiode group of the reference point by dividing each of the values by the sum of the four values (R+G+B+U'). Thus, for example, for the Taos sensor, the normalized red light is $C_{RR}$=R/(R+G+B+U'), the normalized green light is $C_{RG}$=G/(R+G+B+U'), the normalized blue light is $C_{RB}$=B/(R+G+B+U'), and the normalized unfiltered light is $C_{RU}$=U'/(R+G+B+U'). By normalizing the values received for each filtered or unfiltered photodiode group, the values are independent of the distance of the light source to the sensor.

Then at block 215, the controller commands the lamp to go to the coolest color (referred to herein as 100% of the operating range of the lamp) possible according to the color model stored in memory in the lamp. When the lamp has produced the coolest color possible, the lamp sends a signal to the controller, and the controller captures a sample of the light emitted by the lamp. Similar to the reference point, multiple samples can be taken and averaged, and the averaged values provided by the sensor for the 100% point are normalized as was done with the reference point and then stored.

At block 220, the controller commands the lamp to go to the warmest color (referred to herein as 0% of the operating range of the lamp) according to the color model stored in memory in the lamp. When the lamp has produced the warmest color possible, the lamp sends a signal to the controller, and the controller captures a sample of the light emitted by the lamp. Similar to the reference point, multiple samples can be taken and averaged, and the averaged values provided by the sensor for the 0% point are normalized as was done with the reference point and then stored.

At block 225, the controller commands the lamp to go to the middle of the operating range (referred to herein as 50% of the operating range of the lamp) according to the color model stored in memory in the lamp. When the lamp has produced the color in the middle of the operating range, the lamp sends a signal to the controller, and the controller captures a sample of the light emitted by the lamp. Similar to the reference point, multiple samples can be taken and averaged, and averaged the values provided by the sensor for the 50% point are normalized as was done with the reference point and then stored.

At block 230, the controller commands the lamp to produce light output corresponding to the point at 25% of the operating range of the lamp according to the color model stored in memory in the lamp. When the lamp has produced the requested color, the lamp sends a signal to the controller, and the controller captures a sample of the light emitted by the lamp. Similar to the reference point, multiple samples can be taken and averaged, and the averaged values provided by the sensor for the 25% point are normalized as was done with the reference point and then stored.

At block 235, the controller commands the lamp to produce light output corresponding to the point at 75% of the operating range of the lamp according to the color model stored in memory in the lamp. When the lamp has produced the requested color, the lamp sends a signal to the controller, and the controller captures a sample of the light emitted by the lamp. Similar to the reference point, multiple samples can be taken and averaged, and the averaged values provided by the sensor for the 75% point are normalized as was done with the reference point and then stored.

Figure 3A:
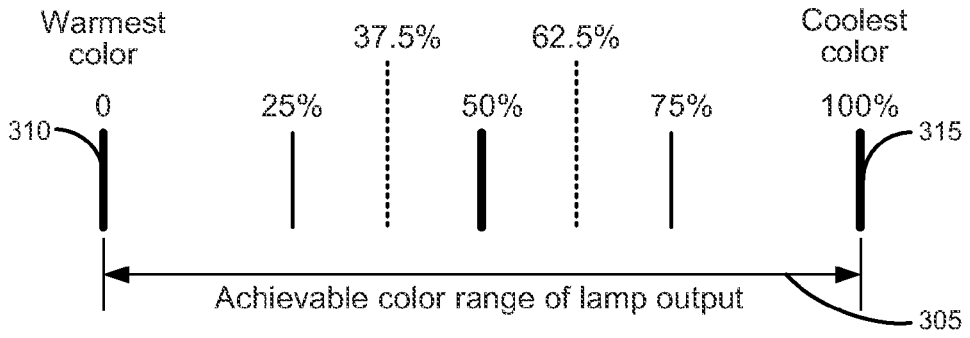
FIGS. 3A-3D depict various example lighting situations that may be encountered by the CCT reproduction algorithm.

The five light samples generated by the LED-based lamp at blocks 215-235 correspond to the 0%, 25%, 50%, 75%, and 100% points of the operating range of the lamp. The achievable color range 305 of the LED-based lamp is shown conceptually in FIG. 3A along with the relative locations of the five sample points. The left end of range 305 is the 0% point 310 of the operating range and corresponds to the warmest color that the lamp can, while the right end of range 305 is the 100% point 315 of the operating range and corresponds to the coolest color that the lamp can produce. Because the color model stored in the memory of the lamp provides information on how to produce an output CCT that is on or near the Planckian locus, the achievable color range 305 is limited to on or near the Planckian locus. A person of skill in the art will recognize that greater than five or fewer than five sample points can be taken and that the points can be taken at other points within the operating range of the lamp.

Then at block 240, the controller processor calculates the relative 'distance' for each of the five light samples from the reference point, that is, the processor quantitatively determines how close the spectra of the light samples are to the spectrum of the reference point. The processor uses the formula $$\sum_x \left[\frac{C_{Sx}}{C_{Rx}} - \frac{C_{Rx}}{C_{Sx}}\right]^2$$

to quantify the distance, where the summation is over the different filtered and unfiltered photodiode groups, and x refers to the particular filtered photodiode group (i.e., red, green, blue, or clear); $C_{Sx}$ is the normalized value for one of the filtered (or unfiltered) photodiode groups of a light sample generated by the LED-based lamp; and $C_{Rx}$ is the normalized value for the reference point of the filtered (or unfiltered) photodiode groups. Essentially, the lighting system comprising the controller 130 and LED-based lamp 110 tries to find an operating point of the lamp that minimizes the value provided by this equation. This particular equation is useful because the approach to the reference point is symmetrical for spectral contributions greater than the reference point and for spectral contributions less than the reference point. A person of skill in the art will recognize that many other equations can also be used to determine a relative distance between spectral values.

The sample point having a spectrum closest to the reference point spectrum is selected at block 245 by the controller processor. At decision block 250, the controller processor determines whether the distance calculated for the selected sample point is less than a particular threshold. The threshold is set to ensure a minimum accuracy of the reproduced spectrum. In one embodiment, the threshold can be based upon a predetermined confidence interval. The lower the specified threshold, the closer the reproduced spectrum will be to the spectrum of the reference point. If the distance is less than the threshold (block 250—Yes), at block 298 the controller processor directs the lamp to go to the selected point. The process ends at block 299.

If the distance is not less than the threshold (block 250—No), the controller processor removes half of the operating range (search space) from consideration and selects two new test points for the lamp to produce. At decision block 255 the controller processor determines whether the selected point is within the lowest 37.5% of the color operating range of the lamp. If the point is within the lowest 37.5% of the color operating range of the lamp (block 255—Yes), at block 280 the controller processor removes the highest 50% of the operating color range from consideration. It should be noted that by removing half of the operating color range from consideration, the search space for the CCT substantially matching the CCT of the light to be reproduced is reduced by half, as is typical with a binary search algorithm. Further, a buffer zone (12.5% in this example) is provided between the range in which the selected point is located and the portion of the operating range that is removed from consideration. The buffer zone allows a margin for error to accommodate any uncertainty that may be related to the sensor readings.

Figure 3B:
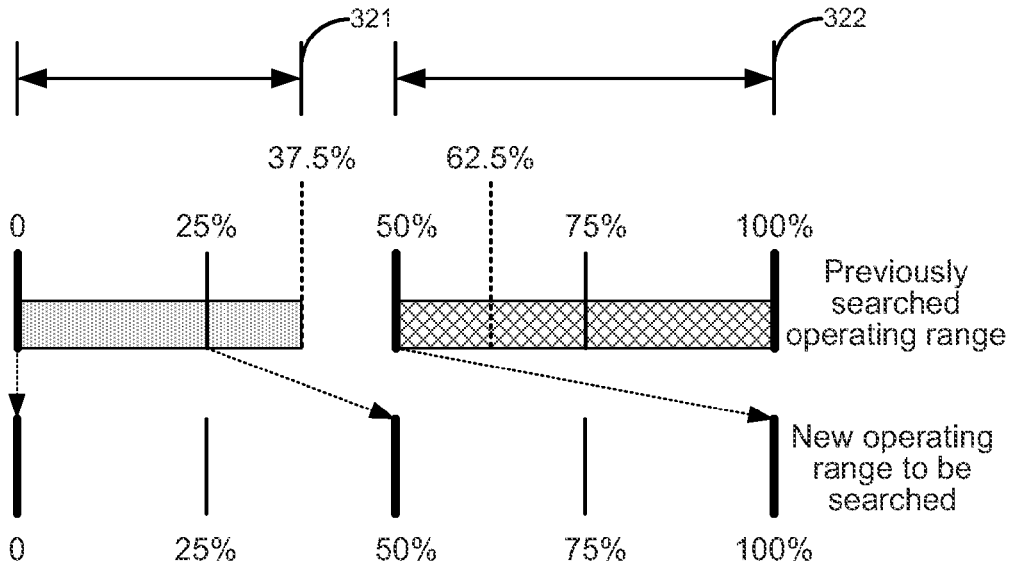

FIG. 3B depicts the originally considered operating range (top range) relative to the new operating range to be searched (bottom range) for the particular case where the selected point is within the portion 321 of the operating range between 0 and 37.5% (grey area). In this case, the portion 322 of the operating range between 50% and 100% (cross-hatched) is removed from consideration. The portion between portions 321 and 322 provides a safety margin for any errors in the sensor readings.

Then at block 282, the controller processor uses the edges of the remaining operating color range as the warmest and coolest colors, and at block 284, the 25% point of the previous color range is used as the 50% point of the new color range. The new operating range is shown relative to the old operating range by the arrows in FIG. 3B. The process returns to block 230 and continues.

If the point is not within the lowest 37.5% of the color operating range of the lamp (block 255—No), at decision block 260 the controller processor determines whether the selected point is within the middle 25% of the color operating range of the lamp. If the point is within the middle 25% of the color operating range of the lamp (block 255—Yes), at block 290 the controller processor removes the highest and lowest 25% of the operating color range from consideration.

Figure 3C:
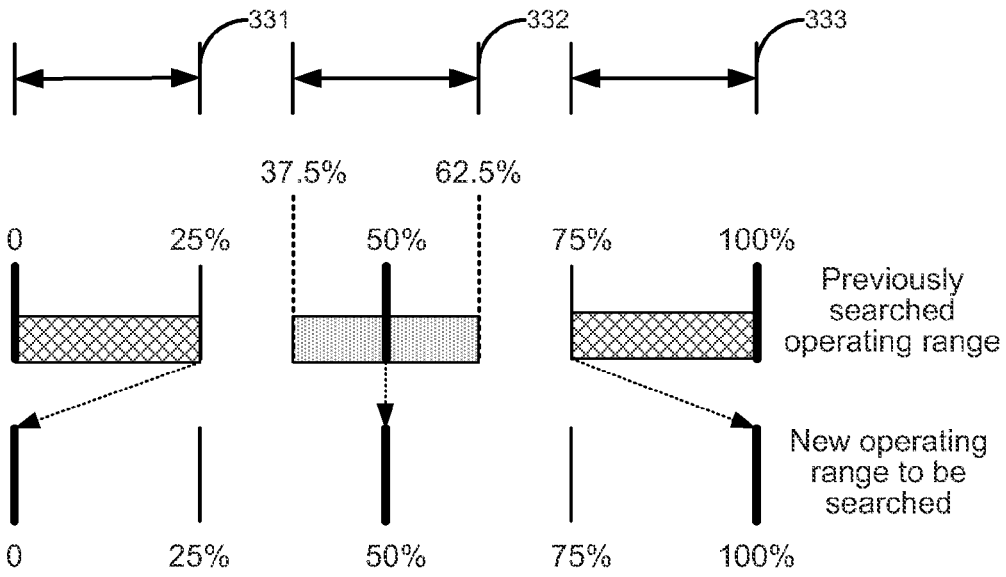

FIG. 3C depicts the originally considered operating range (top range) relative to the new operating range to be searched (bottom range) for the particular case where the selected point is within the portion 332 of the operating range between 37.5 and 62.5% (grey area). In this case, the portions 331, 333 of the operating range between 0% and 25% and between 75% and 100% (cross-hatched) are removed from consideration. The portion between 331 and 332 and the portion between 332 and 333 provide safety margins for any errors in the sensor readings.

Then at block 292, the controller processor uses the edges of the remaining operating color range as the warmest and coolest colors, and at block 294, the 50% point of the previous color range is used as the 50% point of the new color range. The new operating range is shown relative to the old operating range by the arrows in FIG. 3C. The process returns to block 230 and continues.

If the point is not within the middle 25% of the color operating range of the lamp (block 255—No), at block 265 the controller processor removes the lowest 50% of the operating color range from consideration.

Figure 3D:
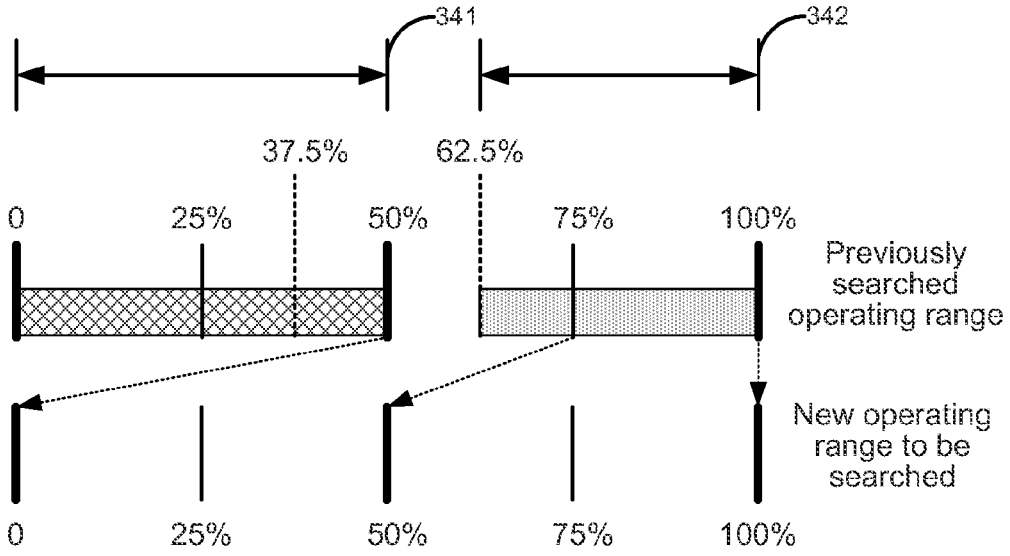

FIG. 3D depicts the originally considered operating range (top range) relative to the new operating range to be searched (bottom range) for the particular case where the selected point is within the portion 342 of the operating range between 62.5% and 100% (grey area). In this case, the portion 341 of the operating range between 0% and 50% (cross-hatched) is removed from consideration. The portion between portions 341 and 342 provides a safety margin for any errors in the sensor readings.

Then at block 270, the controller processor uses the edges of the remaining operating color range as the warmest and coolest colors, and at block 272, the 75% point of the previous color range is used as the 50% point of the new color range. The new operating range is shown relative to the old operating range by the arrows in FIG. 3D. The process returns to block 230 and continues.

Additionally, in one embodiment, every time the controller 130 commands the lamp 110 to go to a certain point in its operating range, the lamp responds by providing the CCT value corresponding to the requested point as stored in the lamp's memory. Then the controller 130 will know the CCT being generated by the lamp 110.

The process iterates the narrowing of the operating range until the LED-based lamp generates a light having a spectrum sufficiently close to the spectrum of the reference point. However, for each subsequent iteration, only two new sample points need to be generated and tested, rather than five. Narrowing the operating range of the lamp essentially performs a one-dimensional search along the Planckian locus.

A person skilled in the art will realize that a different number of sample points in different locations of the operating range can be taken, and a different percentage or different portions of the operating range can be removed from consideration.

Calibration of the LED Strings

Figure 4:
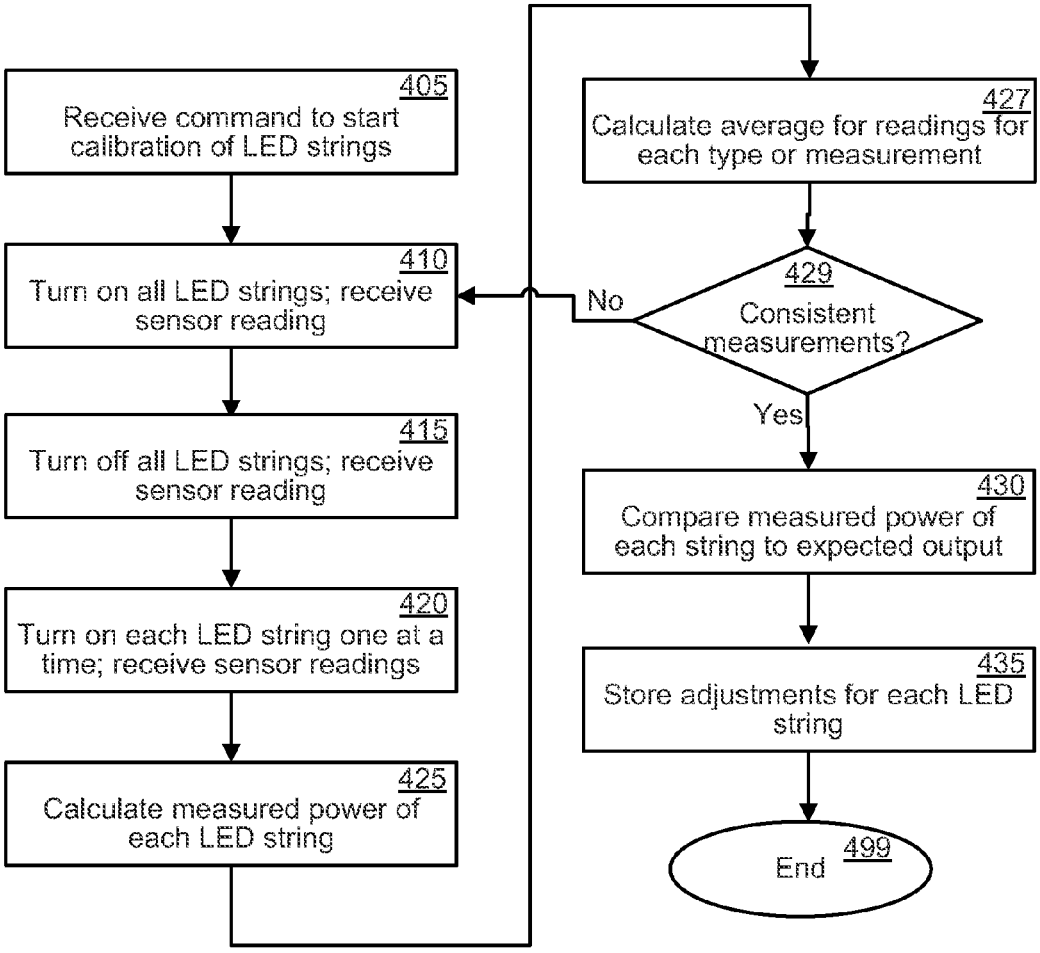
FIG. 4 is a flow diagram illustrating an example process of calibrating an LED-based lamp.

FIG. 4 is a flow diagram illustrating an example process of calibrating an LED-based lamp. The overall CCT of the light generated by the LED-based lamp 110 is sensitive to the relative amount of light provided by the different color LED strings. As an LED ages, the output power of the LED decreases for the same driving current. Thus, it is important to know how much an LEDs output power has deteriorated over time. By calibrating the LED strings in the lamp 110, the lamp 110 can proportionately decrease the output power from the other LED strings to maintain the appropriate CCT of its output light. Alternatively, the lamp 110 can increase the driving current to the LED string to maintain the appropriate amount of light output from the LED string to maintain the appropriate CCT level.

At block 405, the lamp 110 receives a command from the controller 130 to start calibration of the LED strings. The command is received by the communications module 114 in the lamp. In one embodiment, the lamp 110 may be programmed to wait a predetermined amount of time to allow the user to place the controller 130 in a stable location and to aim the sensor at the lamp 110.

After receiving the calibration command, the lamp 110 performs the calibration process, and the controller 130 merely provides measurement information regarding the light generated by the lamp 110. Typically, the power output of an LED driven at a given current will decrease as the LED ages, while the peak wavelength does not drift substantially. Thus, although the sensor 132 in the controller 130 can have different filtered photodiodes, as discussed above, only the unfiltered or clear filtered photodiodes are used to provide feedback to the lamp 110 during the calibration process.

Then at block 410 the lamp turns on all of its LED strings. All of the LED strings are turned on to determine how many lumens of light are being generated by all the LED strings. The LED strings are driven by a current level that at the factory corresponded to an output of 100% power.

When the lamp has finished turning on all the LED strings, the lamp sends the controller a message to capture the light and transmit the sensor readings back. The lamp receives the sensor readings through the transceiver.

Next, at block 415 the lamp turns off all of its LED strings. When the lamp has finished turning off all the LED strings, the lamp sends the controller a message to capture the light and transmit the sensor readings back. The lamp receives the sensor readings through the transceiver. This reading is a reading of the ambient light that can be zeroed out during the calibration calculations.

At block 420 the lamp turns on each of its LED strings one at a time at a predetermined current level as used at block 410, as specified by the calibration table stored in memory in the lamp. After the lamp has finished turning on each of its LED strings, the lamp sends the controller a message to capture the light and transmit the sensor readings back. The lamp receives the sensor readings corresponding to each LED string through the transceiver.

Then at block 425 the lamp processor calculates the measured power of each LED string using the sensor readings. An example scenario is summarized in a table in FIG. 5 for the case where there are three different colored LED strings in the lamp, for example white, red, and blue. In one embodiment, only LEDs having the same color or similar peak wavelengths are placed in the same LED string, for example red LEDs or white LEDs. Measurement A is taken when all three strings are on. Measurement B is taken when all three strings are off so that only ambient light is measured. Measurement C is taken when LED string 1 is on, and LED strings 2 and 3 are off. Measurement D is taken when LED string 2 is on and LED strings 1 and 3 are off. Measurement E is taken when LED string 3 is on and LED strings 1 and 2 are off. Measurement F is taken when LED string 3 is off and LED strings 1 and 2 are on. Measurement G is taken when LED string 2 is off and LED strings 1 and 3 are on. Measurement H is taken when LED string 1 is off and LED strings 2 and 3 are on. The output power of LED string 1 equals (A−B+C−D−E+F+G−H). The output power of LED string 2 equals (A−B−C+D−E+F−G+H). The output power of LED string 3 equals (A−B−C−D+E−F+G+H).

At block 427, the lamp processor calculates an average and standard deviation over all measurements taken for each type of measurement (all LED strings on, all LED strings off, and each LED string on individually).

Then at decision block 429, the lamp processor determines if a sufficient number of data points have been recorded. Multiple data points should be taken and averaged in case a particular measurement was wrong or the ambient light changes or the lamp heats up. If only one set of readings have been taken or the averaged measurements are not consistent such that the fluctuations in the power measurements are greater than a threshold value (block 429—No), the process returns to block 410.

If the averaged measurements are consistent (block 429—Yes), at block 430 the normalized averaged output power of each LED string calculated at block 427 is compared by the lamp processor to the normalized expected power output of that particular LED string stored in the lamp memory. A normalized average output power of each LED string is calculated based on the average output power of each LED string over the average total output power of all of the LED strings. Similarly the normalized expected power output of a LED string is the expected power output of the LED string over the total expected power output of all of the LED strings. A ratio of the calculated output power to the expected output power can be used to determine which LED strings have experienced the most luminance degradation, and the output power form the other LED strings are reduced by that ratio to maintain the same proportion of output power from the lamp to maintain a given CCT. And if other LED strings have also degraded, the total reduction factor can take all of the degradation factors into account. For example, consider the case where string 1 degraded so that it can only provide 80% of its expected output power, string 2 degraded so that it can only provide 90% of its expected output power, and string 3 did not degrade so that it still provides 100% of its expected output power. Then because string 1 degraded the most, all of the other strings should reduce their output power proportionately to maintain the same ratio of contribution from each LED string. In this case, string 1 is still required to provide 100% (factor of 1.0) of its maximum output, while string 2 is required to provide a factor of 0.8/0.9=0.889 of its maximum output, and string 3 is required to provide a factor of 0.8 of its maximum power output. This process ensures that the ratios of the output powers of all the LED strings is constant, thus maintaining the same CCT, even though the intensity is lower.

Alternatively, a ratio of the calculated output power to the expected output power can be used to determine whether a higher current should be applied to the LED string to generate the expected output power. The ratios are stored in the lamp memory at block 435 for use in adjusting the current levels applied to each LED string to ensure that the same expected output power is obtained from each LED string. The process ends at block 499.

Figure 6:
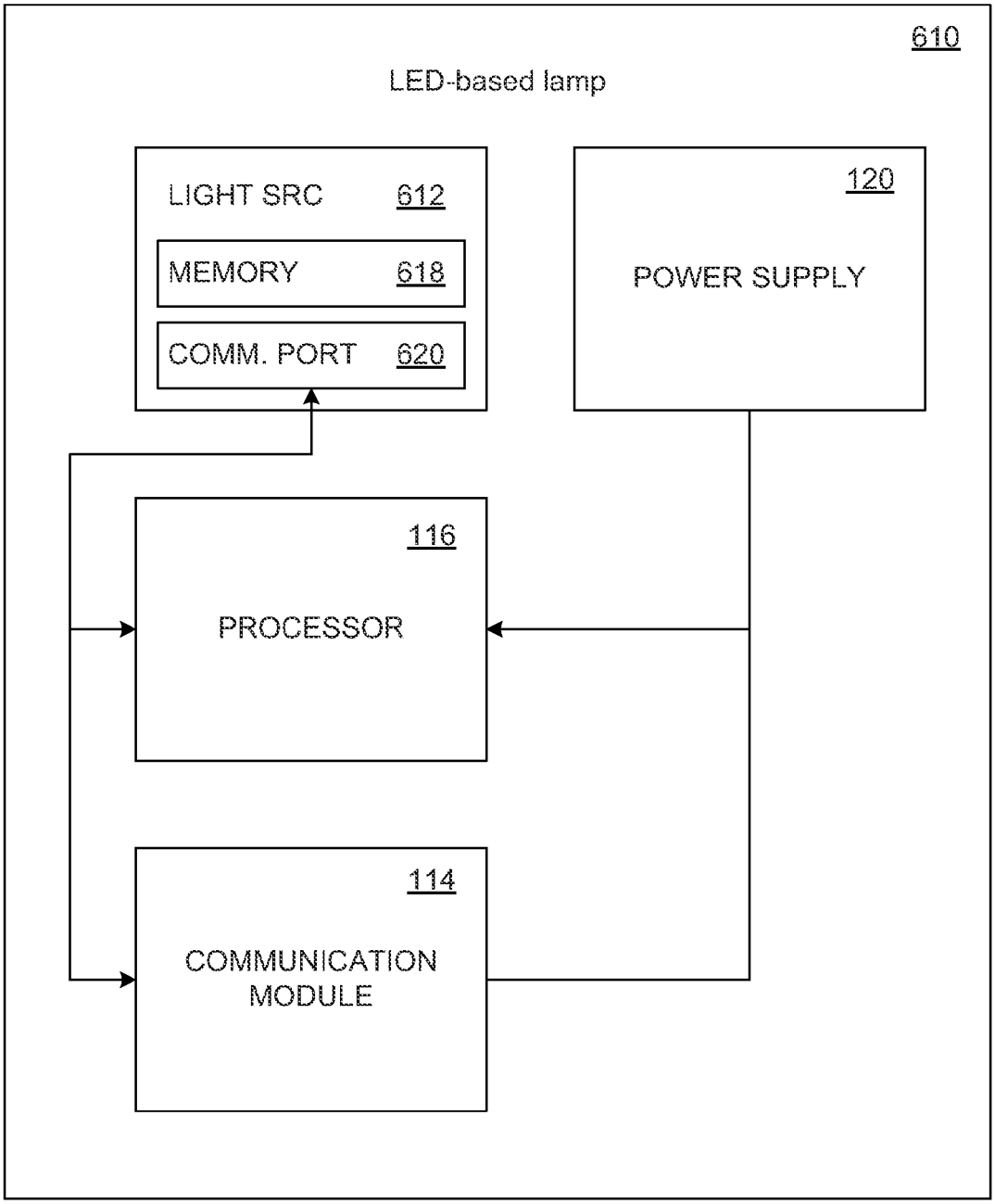
FIG. 6 shows a block diagram illustrating an example of a LED-based lamp with a detachable light source.

FIG. 6 illustrates an example configuration of a LED-based lamp 610. FIG. 1 illustrates that the light source 112, the memory 118, the processor 116, the communications module 114 and the power supply 120 are all part of the LED-based lamp 110. FIG. 6, on the other hand, shows that the light source 612 has its own memory 618. The light source 612 can be a portable unit of one or more LED color strings and the memory 618. The light source 612 can be modularly plugged into the LED-based lamp 610 and detached from the LED-based lamp. The communication port 620 can be a separate communication socket, plug, cable, pin, or interface that can be coupled to the processor 116 and/or the communication module 114. The communication port 620 can be part of the power supply line from the power supply 120 to the light source 612.

The memory 618 can be accessed through a communication port 620. The memory can store a color model and/or a histogram of the one or more LED color strings in the light source 612. The color model and/or the histogram can be created or updated via the communication port 620. The processor 116 can drive the one or more LED color strings according to commands received from the communication module 114 based on the color model or the histogram accessed from the memory 618. The processor 116 and the communication module 114 can communicate with the communication port 620 with a separate connection line or a power supply line from the power supply 120 that connects the light source 612, the processor 116, and the communication module 114.

Unless the context clearly requires otherwise, throughout the description and the claims, the words "comprise," "comprising," and the like are to be construed in an inclusive sense (i.e., to say, in the sense of "including, but not limited to"), as opposed to an exclusive or exhaustive sense. As used herein, the terms "connected," "coupled," or any variant thereof means any connection or coupling, either direct or indirect, between two or more elements. Such a coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. While processes or blocks are presented in a given order in this application, alternative implementations may perform routines having steps performed in a different order, or employ systems having blocks in a different order. Some processes or blocks may be deleted, moved, added, subdivided, combined, and/or modified to provide alternative or subcombinations. Also, while processes or blocks are at times shown as being performed in series, these processes or blocks may instead be performed or implemented in parallel, or may be performed at different times. Further any specific numbers noted herein are only examples. It is understood that alternative implementations may employ differing values or ranges.

The various illustrations and teachings provided herein can also be applied to systems other than the system described above. The elements and acts of the various examples described above can be combined to provide further implementations of the invention.

Any patents and applications and other references noted above, including any that may be listed in accompanying filing papers, are incorporated herein by reference. Aspects of the invention can be modified, if necessary, to employ the systems, functions, and concepts included in such references to provide further implementations of the invention.

These and other changes can be made to the invention in light of the above Detailed Description. While the above description describes certain examples of the invention, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

While certain aspects of the invention are presented below in certain claim forms, the applicant contemplates the various aspects of the invention in any number of claim forms. For example, while only one aspect of the invention is recited as a means-plus-function claim under 35 U.S.C. §112, sixth paragraph, other aspects may likewise be embodied as a means-plus-function claim, or in other forms, such as being embodied in a computer-readable medium. (Any claims intended to be treated under 35 U.S.C. §112, ¶6 will begin with the words "means for.") Accordingly, the applicant reserves the right to add additional claims after filing the application to pursue such additional claim forms for other aspects of the invention.

We claim:

1. A method of performing a search in a one-dimensional search space within chromaticity space quantifying illumination, the method comprising:

providing a target illumination spectrum and an illumination search space;

configuring a predetermined distance threshold from the target illumination spectrum; and narrowing the illumination search space to match the target illumination spectrum by:

selecting by a processor a plurality of points in the illumination search space, wherein the plurality of points correspond to operating levels of light emitting diodes (LEDs) in an LED-based lamp;

determining by the processor a preferred point from the plurality of selected points, wherein the preferred point corresponds to a light generated by the LED-based lamp that has a lamp spectrum closest to the target illumination spectrum out of the plurality of points;

discarding by the processor a portion of the illumination search space that does not include the preferred point, wherein the discarded portion of the illumination search space is at least a buffer zone away from the preferred point; and iterating by the processor the narrowing of the illumination search space in a remaining narrowed search space until one of the selected points provides a final lamp spectrum within the predetermined distance threshold of the target illumination spectrum.

2. The method of claim 1, wherein the illumination search space is contiguous and wherein the buffer zone comprises at least 10% of the contiguous illumination search space.

3. The method of claim 1, wherein the plurality of points are equally spaced.

4. The method of claim 1, wherein the plurality of points include a first end point and a second end point of the illumination search space, a middle point located midway between the first end point and the second end point, a first quarter point midway between the first end point and the middle point, and a second quarter point midway between the second end point and the middle point.

5. The method of claim 4, wherein discarding a portion of the illumination search space includes:

when the preferred point is within 37.5% of the illumination search space from the first end point, discarding a second half of the illumination search space between the middle point and the second end point;

when the preferred point is within 37.5% of the illumination search space from the second end point, discarding a first half of the illumination search space between the first end point and the middle point; and otherwise discarding a first quarter of the illumination search space between the first end point and the first quarter point and discarding a second quarter of the illumination search space between the second quarter point and the second end point.

6. The method of claim 4, wherein the remaining search space includes three of the previously selected plurality of points, wherein iterating the narrowing of the illumination search space includes selecting two newly selected points, and wherein determining a preferred point includes determining which of the three previously selected plurality of points and the two new selected points corresponds to a light generated by the LED-based lamp that has a lamp spectrum closest to the target illumination spectrum.

7. The method of claim 1, wherein the illumination search space is along or near a Planckian locus in chromaticity space.

8. A method of generating with a light-emitting diode (LED)-based lamp a light that has a light spectrum that substantially matches a target spectrum, comprising:

capturing a target light having the target spectrum;

generating with a lamp an actual light spectrum that substantially matches the target spectrum;

decomposing the target light to determine contributions to the target light that correspond to a plurality of wavelength bands;

generating candidates of light with the lamp, wherein the candidates of light are on or near a curve in chromaticity space;

capturing the candidates of light;

decomposing the candidates of light to determine contributions to the candidates of light that correspond to the plurality of wavelength bands; and identifying a closest candidate of light, wherein the contributions to the plurality of wavelength bands of the closest candidate of light substantially matches the contributions to the plurality of wavelength bands of the target light.

9. The method of claim 8, wherein the curve is the Planckian locus.

10. The method of claim 8, wherein the curve is the Planckian locus.

11. The method of claim 8, wherein capturing the target light and decomposing the target light comprises using a plurality of light detectors, wherein the plurality of light detectors receive the target light through a plurality of bandpass filters, and further wherein the plurality of light detectors provide a first plurality of signals corresponding to total incident light intensity received at the plurality of detectors for each type of bandpass filter, and further wherein capturing the candidates of light and decomposing the candidates of light comprises using the plurality of light detectors, wherein the plurality of light detectors receive the candidates of light through the plurality of bandpass filters, and further wherein the plurality of light detectors provide a second plurality of signals for each candidate of light corresponding to total incident light intensity received at the plurality of detectors for each type of bandpass filter.

12. The method of claim 11, wherein the types of bandpass filters includes a clear filter that transmits visible wavelengths.

13. The method of claim 11, wherein identifying the closest candidate of light comprises using an equation to compare the first plurality signals for the target light, and the second plurality of signals for the candidates of light and finding a set of second plurality of signals generated by the lamp that minimizes the equation.

14. The method of claim 8, wherein the LED-based lamp includes a plurality of LED strings, and each of the plurality of LED strings includes a plurality of LEDs having a substantially similar peak wavelength or substantially similar emission spectra.

15. A method of generating with a light-emitting diode (LED)-based lamp light having a light spectrum, wherein the light spectrum substantially matches a reference spectrum of a reference light, the method comprising:

capturing the reference light with a plurality of sensors, wherein the plurality of sensors receive light through a plurality of bandpass filters, and further wherein sensor readings include a signal corresponding to a total intensity of light filtered by each type of bandpass filter;

generating and capturing with the plurality of sensors a first lighting sample having a warmest color in an operating range of the lamp;

generating and capturing with the plurality of sensors a second lighting sample having a coolest color in the operating range of the lamp;

generating and capturing with the plurality of sensors one or more additional lighting samples in the operating range of the lamp between the warmest color and the coolest color;

using an equation to quantitatively determine a preferred sample of the lighting samples that has a spectrum closest to the reference spectrum, wherein the equation is dependent upon the sensor readings for the reference light and the sensor readings for the lighting samples;

when the closeness of the spectrum of the preferred sample is not within a threshold of the reference spectrum, discarding a portion of the operating range of the lamp that does not include the preferred sample, wherein the discarded portion of the operating range is at least a buffer zone away from the preferred sample; and iterating the above steps in a remaining operating range until a spectrum of one of the lighting samples is within the threshold of the reference spectrum.

16. The method of claim 15, wherein the one or more additional lighting samples comprise three lighting samples located at 25%, 50%, and 75% of the operating range from the warmest color.

17. The method of claim 15, wherein discarding a portion of the operating range comprises if the preferred sample is within 37.5% of the operating range from the warmest color, discarding half of the operating range farthest from the warmest color, and if the preferred point is within 37.5% of the operating range from the coolest color, discarding half of the operating range closest to the warmest color, otherwise discarding a quarter of the operating range closest to the warmest color and discarding a quarter of the operating range closest to the coolest color.

18. The method of claim 15, wherein the plurality of bandpass filters includes a clear filter that transmits visible wavelengths.

19. The method of claim 15, wherein the equation comprises $$\sum_x \left[\frac{C_{Sx}}{C_{Rx}} - \frac{C_{Rx}}{C_{Sx}}\right]^2,$$

wherein the summation is over a plurality of bandpass filter types, $C_{Sx}$ is a normalized value for one of the signals corresponding to the total intensity of light received for one type of bandpass filter for a lighting sample, and $C_{Rx}$ is a normalized value for one of the signals corresponding to the total intensity of light received for one type of bandpass filter for the reference light.

20. The method of claim 15, wherein the operating range is along or near a Planckian locus in chromaticity space.

21. A system for generating light having a spectrum substantially similar to a reference spectrum of a reference light, the system comprising:

a light-emitting diode (LED)-based lamp configured to generate candidates of light having different correlated color temperatures (CCT), wherein the candidates of light correspond to points in an operating range of the lamp; and a controller having a sensor, wherein the sensor is configured to capture light impinging on the sensor, wherein the controller is configured to search for a preferred candidate of light in the operating range of the LED-based lamp that produces a spectrum substantially similar to the reference spectrum based on the captured light.

22. The system of claim 21, wherein operating range of the lamp is along or near a Planckian locus in chromaticity space.

23. The system of claim 21, wherein the sensor has a plurality of light-sensitive elements that receive light through a plurality of bandpass filters, and the plurality of light-sensitive elements provide a plurality of signals corresponding to total incident light intensity received at the plurality of detectors for each type of bandpass filter, and further wherein the preferred candidate of light is identified by using an equation to compare a first plurality signals for the target light to a second plurality of signals for each of the candidates of light, and identifying the preferred candidate of light that generates the set of second plurality of signals that minimizes the equation.

24. The system of claim 21, wherein the types of bandpass filters includes a clear filter that transmits visible wavelengths.

25. A method of calibrating an LED-based lamp having a plurality of LED strings, the method comprising:

turning on the plurality of LED strings simultaneously and receiving sensor readings of generated light;

turning off the plurality of LED strings and receiving sensor readings of ambient light;

turning on each LED string individually and receiving sensor readings for each LED string; and calculating a ratio of measured output power to expected output power for each LED string, wherein the ratios are used as multiplicative factors with driving currents in a color model for the lamp that provides driving currents for each of the plurality of LED strings to produce light having a range of correlated color temperatures (CCT).

26. The method of claim 25, further comprising storing the ratios in a memory.

27. The method of claim 25, wherein each of the plurality of LED strings includes a plurality of LEDs having a substantially similar peak wavelength or substantially similar emission spectra.

28. The method of claim 25, wherein the sensor readings correspond to unfiltered light.

29. A system for calibrating light-emitting diode (LED) strings in an LED-based lamp, the system comprising:

the LED-based lamp configured to run the following lamp settings: turn the plurality of LED strings on, turn the plurality of LED strings off, and turn on each LED string individually, and further configured to receive sensor readings for each of the lamp settings; and a sensor configured to capture light impinging on the sensor and provide sensor readings corresponding to received light intensity, wherein the lamp runs an algorithm to determine a ratio of measured power to expected power for each LED string, and wherein the ratios are used as multiplicative factors with driving currents in a color model for the lamp that provides driving currents for each of the plurality of LED strings to produce light having a range of correlated color temperatures (CCT).

30. The system of claim 29, wherein each of the plurality of LED strings includes a plurality of LEDs having a substantially similar peak wavelength or substantially similar emission spectra.

* * * * *